US006536609B2

(12) United States Patent
Lake

(10) Patent No.: US 6,536,609 B2
(45) Date of Patent: Mar. 25, 2003

(54) VIAL DISPENSER

(75) Inventor: Thomas K. Lake, Hatboro, PA (US)

(73) Assignee: Merck & Co., Inc., Rahway, NJ (US)

( * ) Notice: Subject to any disclaimer, the term of this patent is extended or adjusted under 35 U.S.C. 154(b) by 0 days.

(21) Appl. No.: 09/916,153

(22) Filed: Jul. 26, 2001

(65) Prior Publication Data

US 2002/0084235 A1 Jul. 4, 2002

Related U.S. Application Data

(60) Provisional application No. 60/259,240, filed on Dec. 29, 2000.

(51) Int. Cl.[7] ..... A47F 7/00
(52) U.S. Cl. ..... 211/59.3; 211/74; 312/71
(58) Field of Search ..... 211/74, 75, 59.3, 211/59.2; 312/61, 71

(56) References Cited

U.S. PATENT DOCUMENTS 1,524,748 A * 2/1925 O'Connor
2,289,751 A * 7/1942 Brenholt
D253,213 S * 10/1979 Hudik et al.
4,386,710 A * 6/1983 Dauman ..... 211/59.2
4,479,583 A * 10/1984 Franklin et al. ..... 211/59.2
4,732,282 A * 3/1988 Lockwood ..... 211/59.2
5,115,920 A * 5/1992 Tipton et al. ..... 211/59.2
5,992,651 A * 11/1999 Shaw et al. ..... 211/59.2
6,347,710 B1 * 2/2002 Ryan et al. ..... 211/59.2 X

* cited by examiner

*Primary Examiner*—Robert W. Gibson, Jr.
(74) *Attorney, Agent, or Firm*—James M. Hunter, Jr.; Mark R. Daniel

(57) ABSTRACT

A device suitable for dispensing a plurality of like articles therefrom, the device characterized as having a plurality of columns for storing and dispensing the articles, each column having a front opening for dispensing the articles and a bottom side for holding the articles, each column having resilient spring means for biasing the articles towards the front opening of the column, the improvement being a tilt ramp attached to the front opening, wherein the ramp is at a decreased angle.

11 Claims, 3 Drawing Sheets

VIAL DISPENSER

This application claims the benefit of Provisional Application No. 60/259,240, filed Dec. 29, 2000.

BACKGROUND OF THE INVENTION

The present invention relates to an apparatus for storing and dispensing vials. Generally, the vials of the invention may contain liquid or solid compositions, and more particularly the vials will contain pharmaceutical compositions. The dispenser may be displayed in a suitable location for easy identification and removal of vials for use.

Physicians and nurses typically handle a plurality of vials of medicine, saline and other pharmaceutical compositions daily. Usually these vials are stored in manufacturer's packaged container and kept refrigerated, or the vials can be stored openly on a storage shelf. However, due to the variety of products typically stored in vials, clinicians and nurses require a dispensing apparatus that provide easy access in the selection and removal of particular vials when necessary.

The prior art contains a selection of devices for storing and dispensing a plurality of containers such as vials, bottles, cans, etc. Generally, the containers are of a similar size and shape. The composition within the containers may be sorted within the device according to color, flavor, concentration, variety, etc.

U.S. Pat. No. 5,131,563, issued Jul. 21, 1992 to Yablans, assigned to Pop Display, Inc., teaches an article dispensing apparatus wherein identical articles are vertically aligned in a plurality of separate columns and held in contact with one another. Each column has a dispensing side and a storage side as well as upper and lower sides. The dispensing side of the column has upper and lower sides that cooperate to retain an article until it is dislodged from the column by lifting the lower end and removing the article. One side of a spring coil is resiliently attached to an upper-dispensing side of the apparatus while the second side of the coil is attached to an article pushing assembly. The length of the coil is sufficiently long so that the pushing assembly can extend over the top of the column to the storage side of the apparatus. The coil can be extended so that the pushing assembly is behind the last article on the storage side of the apparatus. In operation, when one article is removed from the column, the spring coil retracts and causes the pushing assembly to advance the remaining articles towards the dispensing side of the column. The resiliency in the coil will continue to retract and move the articles towards the dispensing side of the column until all the articles are removed therefrom.

U.S. Pat. No. 5,240,124, issued Aug. 31, 1993 to Kunz, assigned to Decision Point Marketing, Inc., teaches a point of sale push device. The device can be characterized as having a slidably mounted pusher on parallel rails, wherein the rails have a dispensing side and a closed side. The first end of an resilient coil is attached to the pusher and the second end of the coil is attached to the dispensing side of the rails to allow the pusher to slidably extend to the closed side of the device. The dispensing side of the device has a stop so that articles placed in the device are held there until lifted from the device. After an article is removed from the device, the resilient coil retracts the pusher towards the dispensing side of the device to advance the remaining articles.

U.S. Pat. Nos. 5,743,428 and 5,649,363 to Rankin, VI, issued Apr. 28, 1998 and May 5, 1998, respectively, assigned to Vulcan Spring & Manufacturing Co., teach an apparatus for dispensing items. Rankin, VI teaches a device similar to Yablans, however, the retractable spring coil is vertically mounted atop to column. The coil also has a consecutive numbering sequence printed thereon to coincide to the number of articles remaining in the column.

The foregoing prior art, while providing dispensing devices that display and advance a plurality of articles for easy selection, it fails to provide a device suitable for dispensing vials containing pharmaceutical compositions. A vial dispensing device that provides a sufficient separation of the front most vial from the remaining vial for easy identification and selection is required. A device that maximizes space as well as placement of the vials in the dispenser is also desired.

SUMMARY OF THE INVENTION

The present invention relates to an apparatus for storing and dispensing a plurality of like pharmaceutical articles, comprising a plurality of parallel aligned columns for storing the articles, the articles characterized as a first article, several articles, and a rear article contacting one another, each column having a bottom side for holding articles and a front opening for dispensing the articles, the first article being adjacent to the front opening and the remaining articles being held in the column behind the first article, the articles in the column being biased from the rear article towards the first article by resilient spring means, the apparatus further comprising a tilt ramp attached to the front opening at a sufficient length and decreased angle to the bottom side of the column to provide space between the first and several articles allowing the first article to separate contact from the several article for removal of the first article from the front opening, the next of several articles being biased toward the front opening by elastic means.

The invention further relates to a method for arranging several dispensers having the tilt ramp to provide improved identification and dispensing of articles.

BRIEF DESCRIPTION OF THE DRAWINGS

Other novel features and advantages of the present invention will become apparent from the following description when taken in conjunction with the accompanying drawings, in which.

DETAILED DESCRIPTION OF THE INVENTION

It should be understood that while the apparatus of the present can be used for storing and dispensing a plurality of like articles, a typical embodiment of the invention is suitable for storing and dispensing numerous pharmaceutical compositions, such as formulations, vaccines, serums, etc. While it will become obvious to those skilled in the art the numerous type of articles that are suitable for storing and dispensing in the apparatus of the invention, typical articles are pharmaceutical vials for vaccines, serums and the like. One preferred vial for storage and dispensing is known in the art as a 0.5 mm glass vial.

Figure 1:
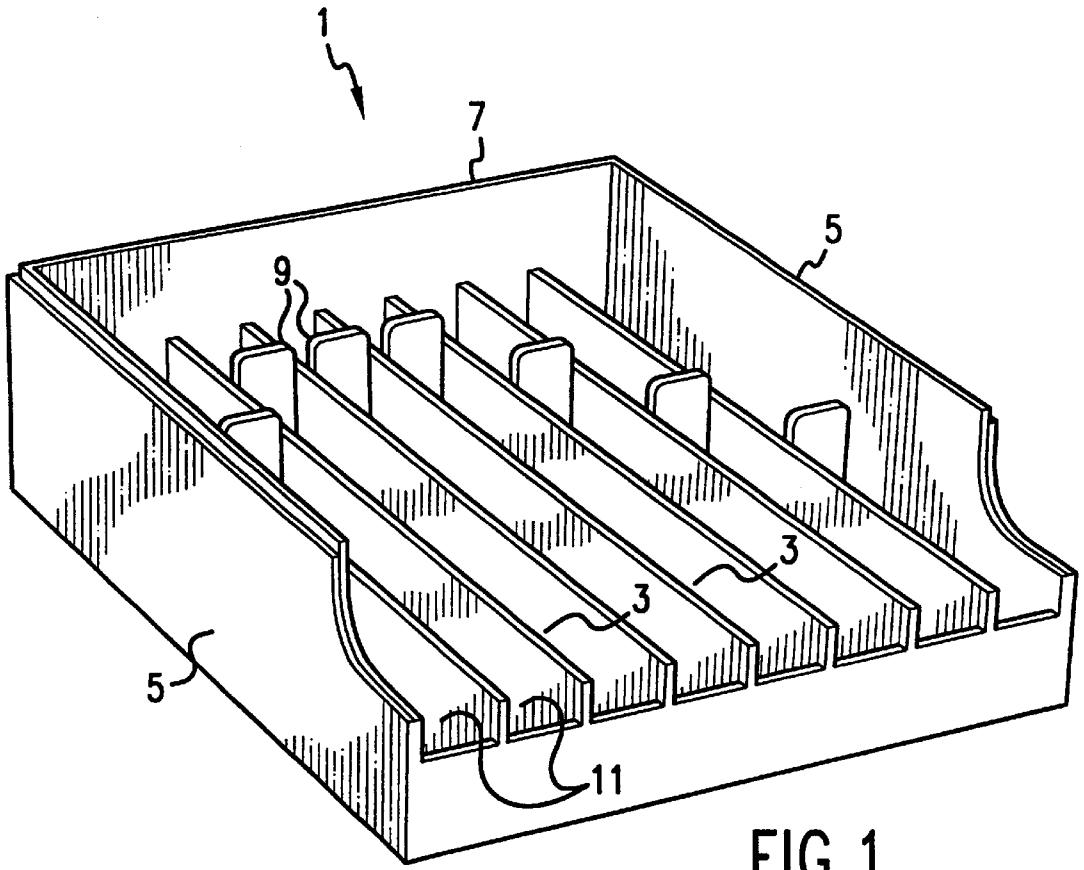
FIG. 1 illustrates an oblique view in elevation of the vial dispenser of the invention.

Referring to the drawings, FIG. 1 illustrates an oblique view in elevation of the dispenser of the invention, wherein the dispenser 1 may be characterized as having a plurality horizontally, aligned columns 3 inside of a base having side walls 5 and back wall 7. A pushing assembly 9 is arranged vertically to the position and slidably attached in each column 3. The pushing assembly slides the length of column 9.

Figure 2:
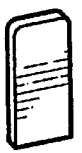
FIG. 2 illustrates an oblique view in elevation of the pusher of the invention.

FIG. 2 illustrates an oblique view in elevation of the pushing assembly 9 of the invention. Generally, attached to pushing assembly 9 is a first end of resilient, elasticity means, the second end of the resilient means being attached to front opening 11. Typically, the resilient, elasticity means is a metal or polymeric, spring coil that rests behind pusher assembly 9. During operation, the elasticity means is stretched by sliding pushing assembly 9 from a rest position where it abuts front opening 11 to the end of column 3 abutting back wall 7. When articles, e.g. vials, are placed in column 3 between pusher assembly 9 and front opening 11, the elasticity means provides biasing by retracting from a stretched position, thereby when a front article is removed from the column, the elasticity means, by contracting, moves the remaining articles in the column towards front opening 11.

Figure 3:
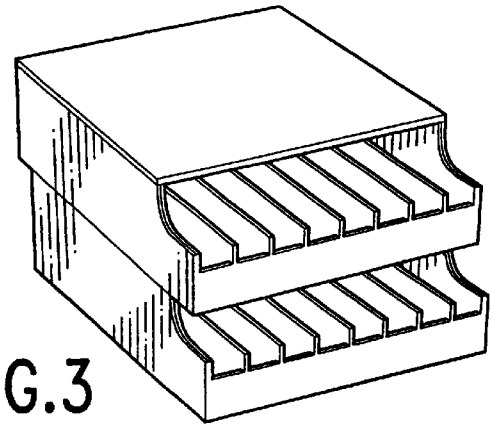
FIG. 3 illustrates an oblique view in elevation of a stack arrangement of the dispenser of the invention.

FIG. 3 illustrates an oblique view in elevation of the dispenser 1 in a stack arrangement, wherein several dispensers are placed one atop another so that the front opening 11 of each dispenser is easily accessible for identification and removal of a vial from column 3 for administration to a patient.

Figure 4A:
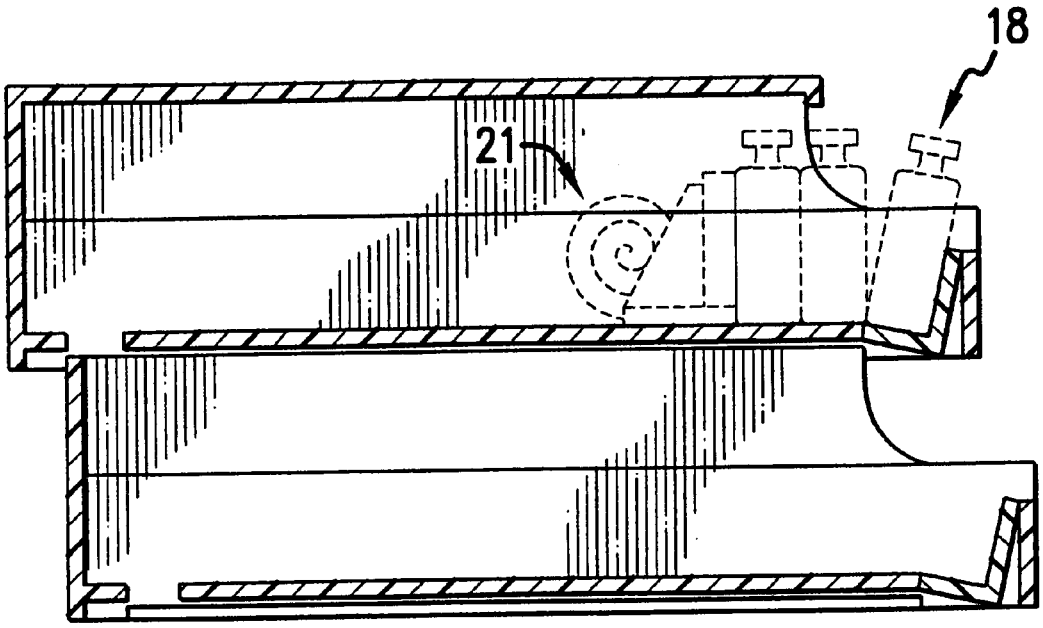
FIG. 4*a* illustrates a side view in elevation of the vial dispenser of the invention further illustrating the tilt ramp of the front opening.

FIG. 4*a* illustrates a side view in elevation of dispenser 1 further illustrating tilt ramp 13 attached at front opening 11 of column 3. Tilt ramp 13 is characterized as means for advancing the front most vial in column 3 to a position where the top of the vial, in a horizontal position, tilts away from back wall 7 of dispenser 1 at an angle of from about 12° to about 18°. Tilt ramp 13 positions the front vial away from the remaining vials for easy identification and removal from the apparatus. Attached at the bottom side of column 3 is ramp 15 having a length of about the diameter of a vials to be contained in the dispenser. Tilt ramp 13 is further characterized as an attachment to the vertically arranged retaining wall 17, wherein the height of the wall is sufficient to securely hold a vial therein. Retaining wall 17 is elevated downwardly, away from the vertical walls 5 and 7 of dispenser 1 at an angle of from about 12° to about 18°, so that the angle of ramp 15 and wall 17 remain at an angle of about 90°. Retaining wall 17 may conveniently have a pad attached thereto for absorbing shock resulting from the biasing of several vials in column 3.

As further illustrated in FIG. 4*a,* several dispensers 1 may be placed atop each other for easy identification and selection of vials containing different compositions therein. Different arrangements of the vials in the dispensers, different number sequencing, color coding, etc., to assist one in readily identifying like vials containing different compositions will become apparent to those skilled in the art. In such an arrangement, a maximum of about five or six dispensers may be stacked atop each. Generally, the dispensers are arranged in a stair step fashion each subsequent dispenser in the stack is placed a measured distance away from the front opening of the dispenser underneath the next dispenser.

Figure 4B:
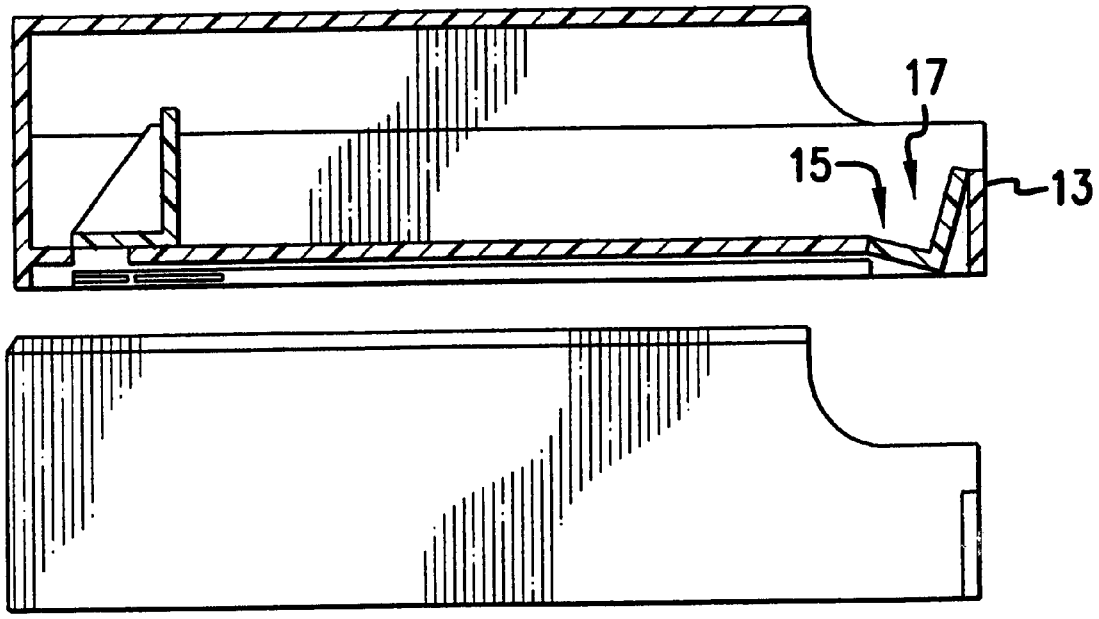
FIG. 4*b* illustrates a side view in elevation of the vial dispenser wherein the tilt ramp and the column are depicted as containing several vials. Push assembly with spring coil is advancing vials in the dispenser.

FIG. 4*b* illustrates a stacking arrangement of the dispensers wherein vials are shown being advanced through a column by a push assemble 9, a spring means 21 providing the force for moving the vials 18. The dispensers can be stacked is a 'stair step' fashion, wherein the upper dispenser slightly 'under hangs' the lower dispenser as shown in the figure.

Figure 5:
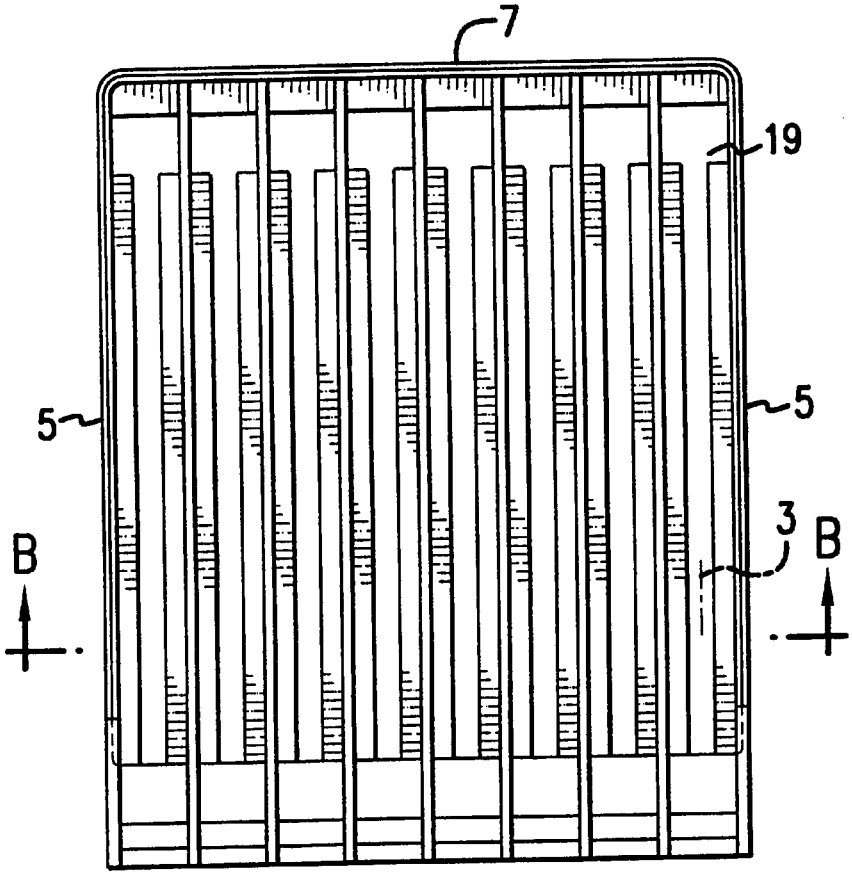
FIG. 5 is a top view in elevation of the dispenser illustrating the columns.

FIG. 5 illustrates a top view in elevation of the dispenser of the invention. A plurality of independently operated linear columns 3 are arranged in a parallel fashion. Exterior walls 5 and 7 define the outer boundaries of the dispenser, and front opening 11 is opposite back wall 7.

Figure 6:
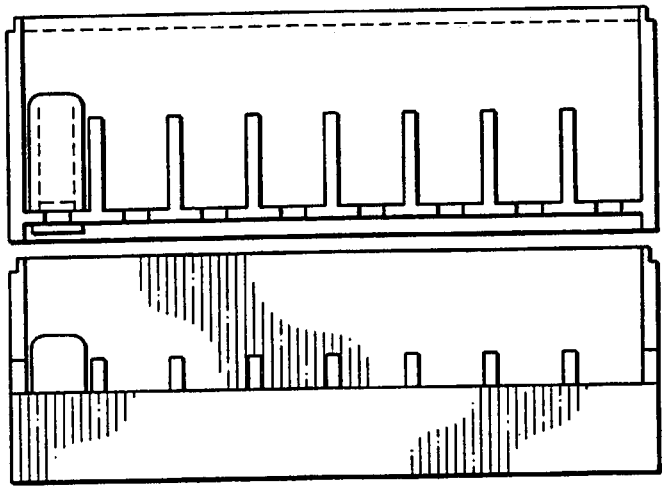
FIG. 6 is a front view in elevation of the dispenser.

FIG. 6 illustrates a sectional view along B—B of FIG. 5, behind the tilt ramp illustrates the location of the pusher assembly 9 in column 3. The pusher assembly is slidably attached to tracks 19 for moving vials from back wall 7 in column 9 to the front opening 11. The moving means typically provide biasing movement for moving remaining vials forward and a next vial into tilt ramp 13 after the front vial is withdrawn from the tilt ramp.

In a general embodiment of the invention, there is described a vial dispensing apparatus particularly suitable for storing and dispensing vials containing pharmaceutical compositions. The dispenser can be described as an apparatus for storing and dispensing a plurality of like articles, the dispenser comprising a plurality of parallel, aligned columns for storing the articles, where the article is preferable a vial. The vials can be characterized as a first vial, a rear vial, and several vials there between, wherein the vials are in contact with one another along the side edges thereof. Each column has of the dispenser has a bottom side for holding the vials and a front opening for dispensing the vials, the first vial is normally adjacent to the front opening of the dispenser, and the remaining vials are held in the column behind the first vial. The vials in the column are biased from the rear vial towards the first vial by resilient spring means. The biasing means operate to move a second vial to the front opening when the first vial is removed from the dispenser. The dispenser further comprising a tilt ramp attached to the front opening at a sufficient length and decreased angle to the bottom side of the column to provide space between the first and several vials allowing the first vial to separate contact along the side edge from the several vials, but remain in contact along the bottom end of the first and second vials, for removal of the first vial from the front opening, the next of several vials being biased toward the front opening by resilient spring means.

Tilt ramp 13 attached to the front opening of the dispenser provides a mechanism wherein the first vial can be appropriately separated from the remaining vials in the column from removal from the dispenser by grasping with the hand or other suitable means. The vials, typically contacting one another along the leading and rear edges as they are aligned within the column, are separated except at the bottom end when the front vial rests in the tilt ramp. The tilt ramp can be better described as bottom ramp 15 and side ramp 17. The bottom and side ramps cooperate to provide an attachment to each column of the invention for the resting of the forward most vial in a column until it is removed therefrom. This mechanism provides a stable resting place for vials in the column to be easily removed. The angle between bottom and side ramps 15 and 17, respectively, will generally be about 90°. Optionally, a vertically standing wall at the front of the dispenser, as shown in FIG. 4*b* can be used to support side ramp 17.

What is claimed is:

1. An apparatus for storing and dispensing a plurality of like pharmaceutical articles, comprising a plurality of parallel aligned columns for storing the articles, the articles characterized as a first article, several articles, and a rear article contacting one another, each column having a bottom side for holding articles and a front opening for dispensing the articles, the first article being adjacent to the front opening and the remaining articles being held in the column behind the first article, the articles in the column being biased from the rear article towards the first article by spring means, the apparatus further comprising a tilt ramp attached to the front opening at a sufficient length and decreased angle to the bottom side of the column to provide space between the first article and several articles allowing the first article to separate contact from the several articles for removal of the first article from the front opening, the next of several articles being biased toward the front opening by said spring means.

2. The apparatus according to claim 1, wherein the tilt ramp has an absorption pad attached.

3. The apparatus according to claim 1, wherein the tilt ramp is position at an angle away from the dispenser of from about 12° to about 18°.

4. The apparatus according to claim 1, wherein the article is a vial.

5. The apparatus according to claim 4, wherein the vials are 0.5 mm glass vials.

6. A vial dispenser for storing and dispensing a plurality of like pharmaceutical vials, comprising a plurality of parallel aligned columns for storing the vials, the vials characterized as a first vial, several vials, and a rear vial contacting one another, each column having a bottom side for holding the vials and a front opening for dispensing the vials, the first vial being adjacent to the front opening and the remaining vials being held in the column behind the first vial, the vials in the column being biased from the rear vial towards the first vial by spring means, the next of several vials being biases toward the front opening by said spring means, the dispenser further comprising a tilt ramp attached to the front opening at a sufficient length and decreased angle to the bottom side of the column to provide space between the first and the several vials allowing the first vial to separate contact from the several vials for removal of the first vial from the front opening of the dispenser.

7. The vial dispenser according to claim 6, wherein several dispensers are arranged one atop another so that the front of each dispenser is accessible.

8. The vial dispenser according to claim 7, wherein the vials are 0.5 mm glass vials.

9. The vial dispenser according to claim 8, wherein the tilt ramp provides separation of the first vial from the several vials and the rear vials for removal of the first vial from the dispenser.

10. The vial dispenser according to claim 9, wherein several dispensers are arranged one atop another in a stair step fashion.

11. The vial dispenser according to claim 10, wherein the tilt ramp tilts away from the back wall at an angle of from about 12 to about 18 degrees.

* * * * *